US006981742B1

(12) United States Patent
Hsiao

(10) Patent No.: US 6,981,742 B1
(45) Date of Patent: Jan. 3, 2006

(54) CUSHION FOR BACKREST OF CHAIR

(75) Inventor: Jin-Long Hsiao, Taichung (TW)

(73) Assignee: Chen Hsing Enterprise Co., Ltd., Zhuchi Hsiang (TW)

( * ) Notice: Subject to any disclaimer, the term of this patent is extended or adjusted under 35 U.S.C. 154(b) by 0 days.

(21) Appl. No.: 10/871,779

(22) Filed: Jun. 19, 2004

(51) Int. Cl.
*A47C 3/025* (2006.01)
*A47C 3/00* (2006.01)
*A47C 7/02* (2006.01)

(52) U.S. Cl. ..... 297/284.4; 297/284.1; 297/452.3; 297/285

(58) Field of Classification Search ..... 297/284.4, 297/284.1, 452.3, 452.31, 285
See application file for complete search history.

(56) References Cited

U.S. PATENT DOCUMENTS 5,217,278 A * 6/1993 Harrison et al. ..... 297/284.7
5,335,965 A * 8/1994 Sessini ..... 297/284.4
5,567,011 A * 10/1996 Sessini ..... 297/284.7
6,030,041 A * 2/2000 Hsiao ..... 297/284.4
6,227,617 B1 * 5/2001 von Moller ..... 297/284.4
6,758,522 B2 * 7/2004 Ligor et al. ..... 297/284.4
6,779,844 B2 * 8/2004 Dosen et al. ..... 297/284.4
6,805,405 B2 * 10/2004 Koo ..... 297/284.7
2002/0113472 A1 * 8/2002 Blendea et al. ..... 297/284.4

* cited by examiner

*Primary Examiner*—Peter M. Cuomo
*Assistant Examiner*—Sarah C. Burnham
(74) *Attorney, Agent, or Firm*—Alan D. Kamrath; Nikolai & Mersereau, P.A.

(57) ABSTRACT

A cushion includes a flexible curved main body having a first end formed with a fixed portion and a second end formed with a movable portion, and an elastic mechanism mounted on the main body and biased between the fixed portion and the movable portion of the main body. Thus, the elastic mechanism is stretched by the movable portion of the main body to mate with variation of the curvature of the main body, so that when the main body is pressed and deformed by the user's weight, the main body has a greater elastic action, and the curvature of the main body is changed automatically by the elastic force of the elastic mechanism so as to fit users of different statures and weights.

8 Claims, 8 Drawing Sheets

CUSHION FOR BACKREST OF CHAIR

BACKGROUND OF THE INVENTION

1. Field of the Invention

The present invention relates to a cushion, and more particularly to a cushion for a backrest of a chair.

2. Description of the Related Art

A conventional cushion for a backrest of a chair in accordance with the prior art shown in FIG. 9 comprises a curved main body 50 having a first end formed with a fixed portion 51 and a second end formed with a movable portion 52, an adjusting device 53 mounted on the fixed portion 51 of the main body 50, and a guide wire 54 having a first end connected to the movable portion 52 of the main body 50 and a second end connected to the adjusting device 53. Thus, the guide wire 54 is driven and moved by operation of the adjusting device 53 to pull or release the movable portion 52 of the main body 50 so as to adjust the curvature of the main body 50.

However, the curvature of the main body 50 is changed by operation of the adjusting device 53, so that the curvature of the main body 50 cannot be adjusted automatically, thereby causing inconvenience to a user in adjustment of the curvature of the cushion.

SUMMARY OF THE INVENTION

In accordance with the present invention, there is provided a cushion, comprising:

a flexible curved main body having a first end formed with a fixed portion and a second end formed with a movable portion; and an elastic mechanism mounted on the main body and biased between the fixed portion and the movable portion of the main body.

The primary objective of the present invention is to provide a cushion whose curvature can be adjusted automatically so as to fit users of different statures.

Another objective of the present invention is to provide a cushion, wherein the elastic mechanism is stretched by the pulling action of the movable portion of the main body to counteract the user's weight and to mate with variation of the curvature of the main body, so that when the main body is pressed and deformed by the user's weight, the main body has a greater elastic action, and the curvature of the main body is arbitrarily changed in an automatic manner by the elastic force of the elastic mechanism, so as to fit users of different statures and weights.

A further objective of the present invention is to provide a cushion that only needs to provide the elastic mechanism to reach the purpose of changing the curvature of the cushion arbitrarily, thereby decreasing costs of fabrication.

Further benefits and advantages of the present invention will become apparent after a careful reading of the detailed description with appropriate reference to the accompanying drawings.

DETAILED DESCRIPTION OF THE INVENTION

Figure 1:
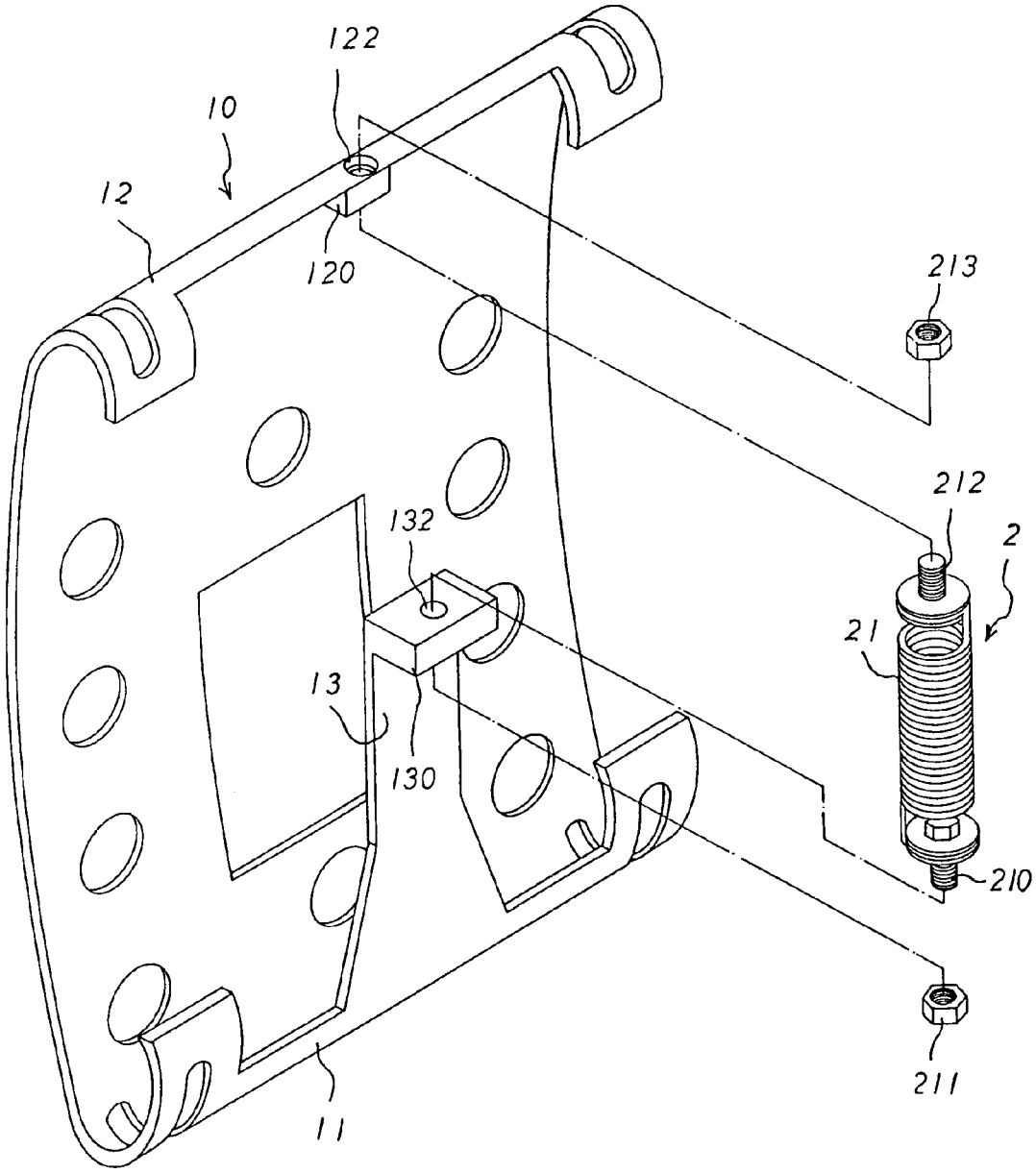
FIG. 1 is an exploded perspective view of a cushion in accordance with the preferred embodiment of the present invention.
Figure 2:
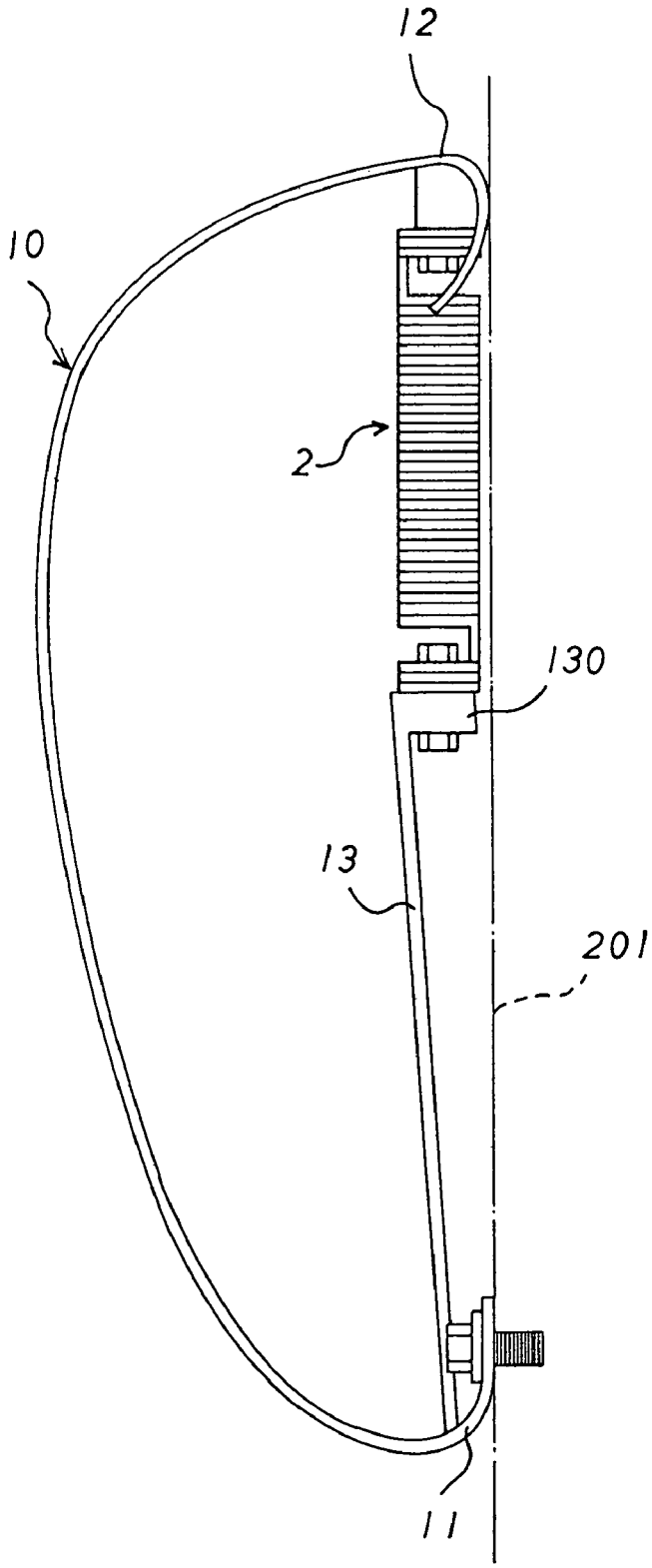
FIG. 2 is a side plan assembly view of the cushion as shown in FIG. 1.
Figure 3:
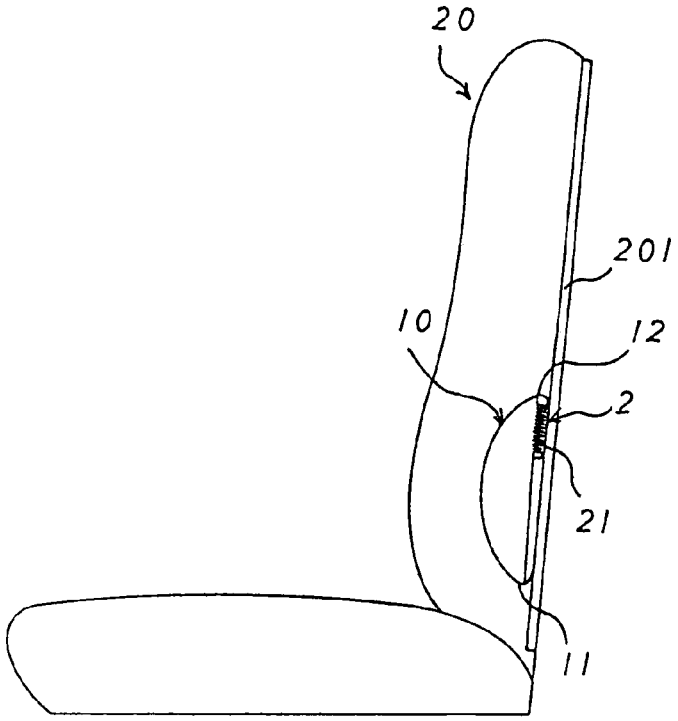
FIG. 3 is a schematic operational view of the cushion as shown in FIG. 2 in use.

Referring to the drawings and initially to FIGS. 1–3, a cushion in accordance with the preferred embodiment of the present invention comprises a flexible curved main body 10 having a first end formed with a fixed portion 11 and a second end formed with a movable portion 12, and an elastic mechanism 2 mounted on the main body 10 and biased between the fixed portion 11 and the movable portion 12 of the main body 10.

The elastic mechanism 2 includes a tensile spring 21 having a first end secured on the fixed portion 11 of the main body 10 and a second end secured on the movable portion 12 of the main body 10.

The fixed portion 11 of the main body 10 has a mediate portion formed with a substantially inverted L-shaped support plate 13 mounted on the first end of the tensile spring 21 of the elastic mechanism 2. The support plate 13 of the fixed portion 11 has a distal end formed with a planar support face 130 to support the first end of the tensile spring 21 of the elastic mechanism 2. The support face 130 of the support plate 13 is formed with a through hole 132, and the first end of the tensile spring 21 is provided with a threaded rod 210 extended through the through hole 132 of the support face 130. A nut 211 is screwed onto the threaded rod 210 of the first end of the tensile spring 21 and rested on a side of the support face 130 of the support plate 13.

The movable portion 12 of the main body 10 has a mediate portion formed with a support block 120 mounted on the second end of the tensile spring 21 of the elastic mechanism 2. The support block 120 of the movable portion 12 is formed with a through hole 122, and the second end of the tensile spring 21 is provided with a threaded rod 212 extended through the through hole 122 of the movable portion 12. A nut 213 is screwed onto the threaded rod 212 of the second end of the tensile spring 21 and rested on a side of the movable portion 12.

As shown in FIG. 3, the fixed portion 11 of the main body 10 is fixed on a backrest 201 of a chair 20, and the movable portion 12 of the main body 10 is pulled by the elastic force of the tensile spring 21 of the elastic mechanism 2, so that the main body 10 is pulled by the tensile spring 21 to have a smaller curvature.

Figure 4:
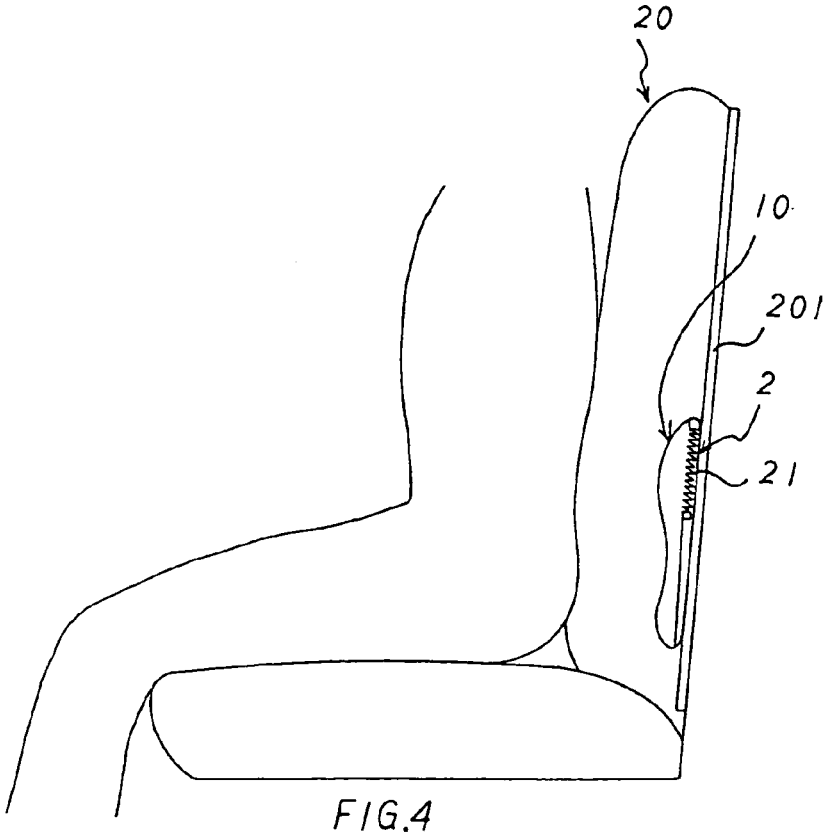
FIG. 4 is a schematic operational view of the cushion as shown in FIG. 3 in use.
Figure 5:
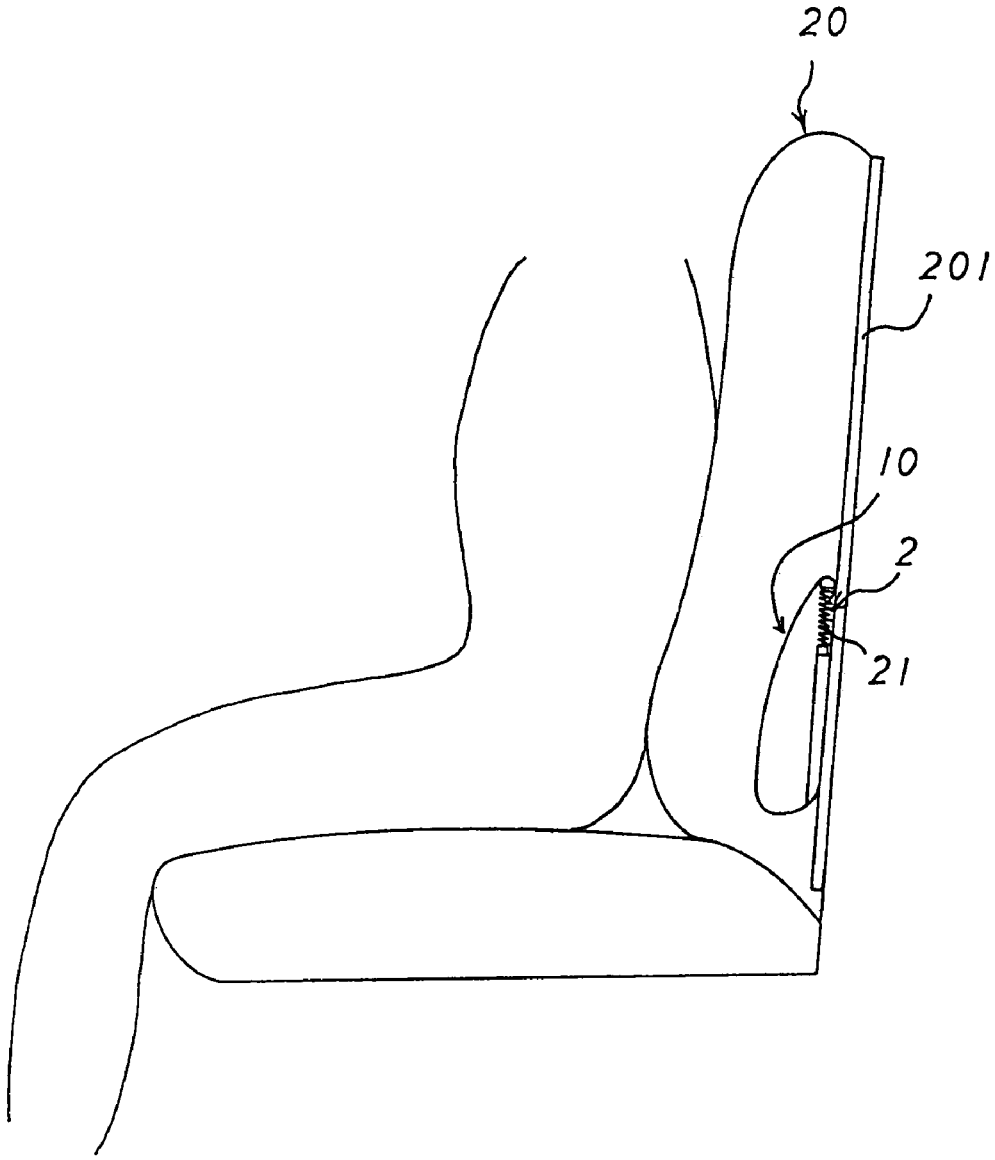
FIG. 5 is a schematic operational view of the cushion as shown in FIG. 3 in use.

As shown in FIGS. 4 and 5, when a user's back is rested on the main body 10 of the cushion, the main body 10 is pressed and deformed by the user's weight to form a greater curvature and to pull the movable portion 12 outward, so that the curvature of the main body 10 is changed by the pressure of the user's weight. In such a manner, the tensile spring 21 of the elastic mechanism 2 is stretched by the pulling action of the movable portion 12 of the main body 10 to counteract the user's weight and to mate with variation of the curvature of the main body 10, so that the main body 10 has a greater elastic action, and the curvature of the main body 10 is arbitrarily changed in an automatic manner by the elastic force of the tensile spring 21 of the elastic mechanism 2, so as to fit users of different statures and weights.

Figure 6:
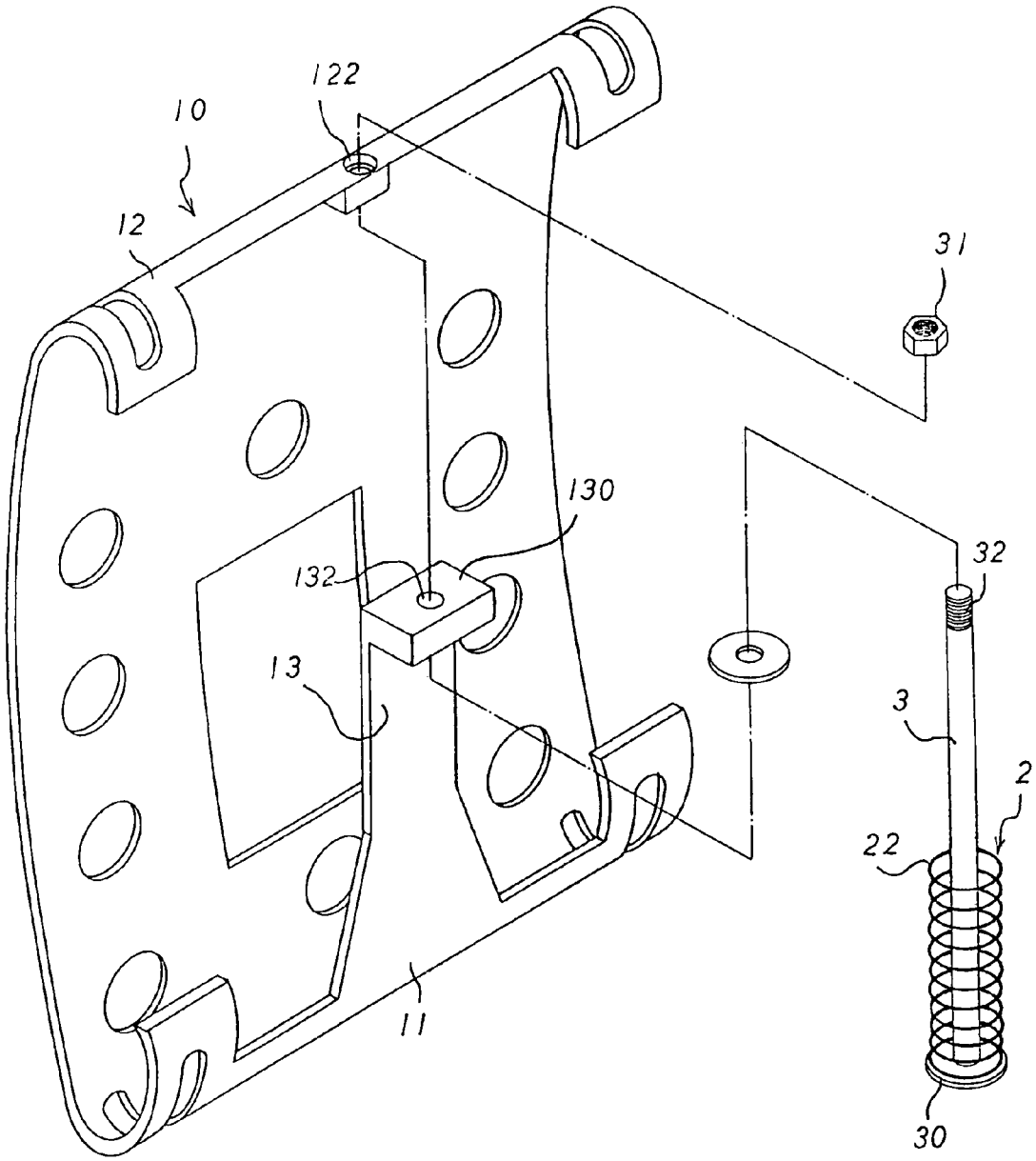
FIG. 6 is an exploded perspective view of a cushion in accordance with another embodiment of the present invention.
Figure 7:
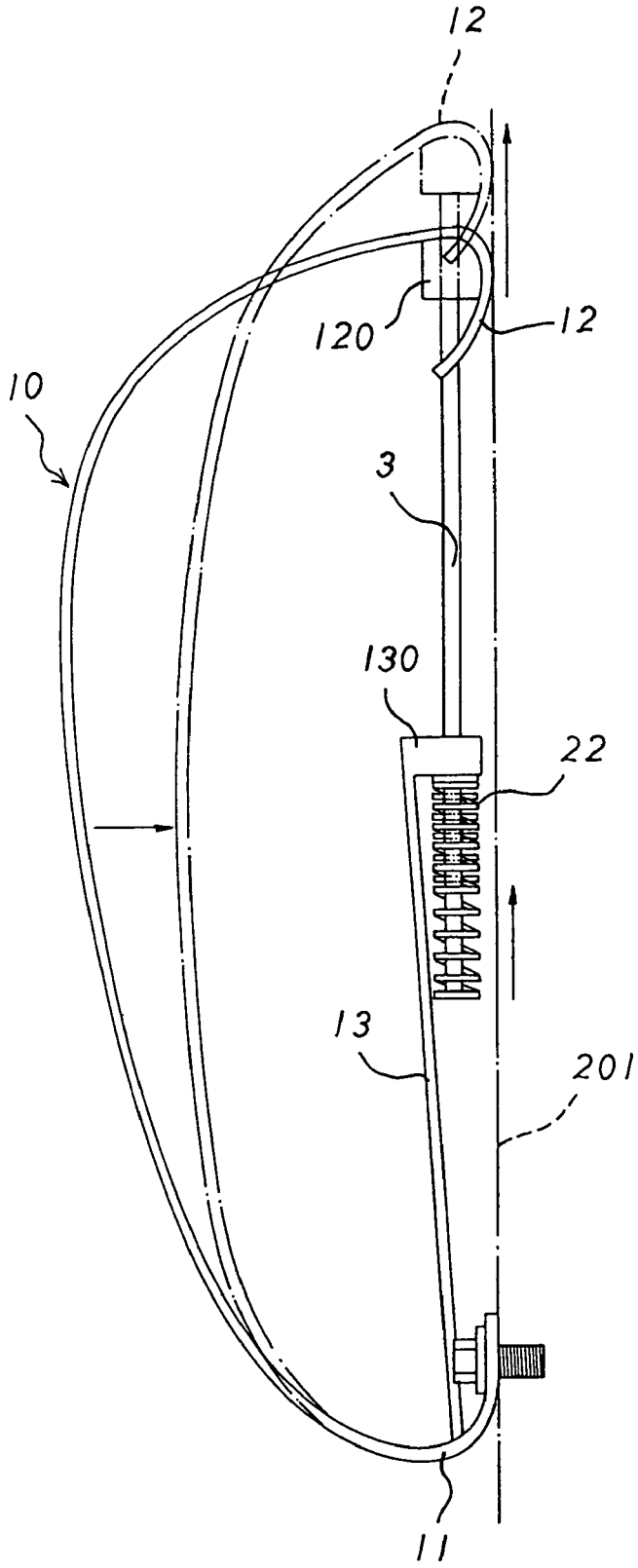
FIG. 7 is a side plan assembly operational view of the cushion as shown in FIG. 6.

Referring to FIGS. 6 and 7, the elastic mechanism 2 includes a support rod 3 having a first end extended through the support plate 13 of the fixed portion 11 and a second end secured on the movable portion 12 of the main body 10, and a compression spring 22 mounted on the support rod 3 and urged between the support plate 13 of the fixed portion 11 and the first end of the support rod 3. The first end of the support rod 3 is provided with an urging plate 30 rested on a first end of the compression spring 22 which has a second end rested on a side of the support face 130 of the support plate 13. The support rod 3 is slidably mounted in the through hole 132 of the support face 130. The second end of the support rod 3 is formed with an outer thread 32 extended through the through hole 122 of the movable portion 12. A nut 31 is screwed onto the outer thread 32 of the support rod 3 and rested on a side of the movable portion 12.

Figure 8:
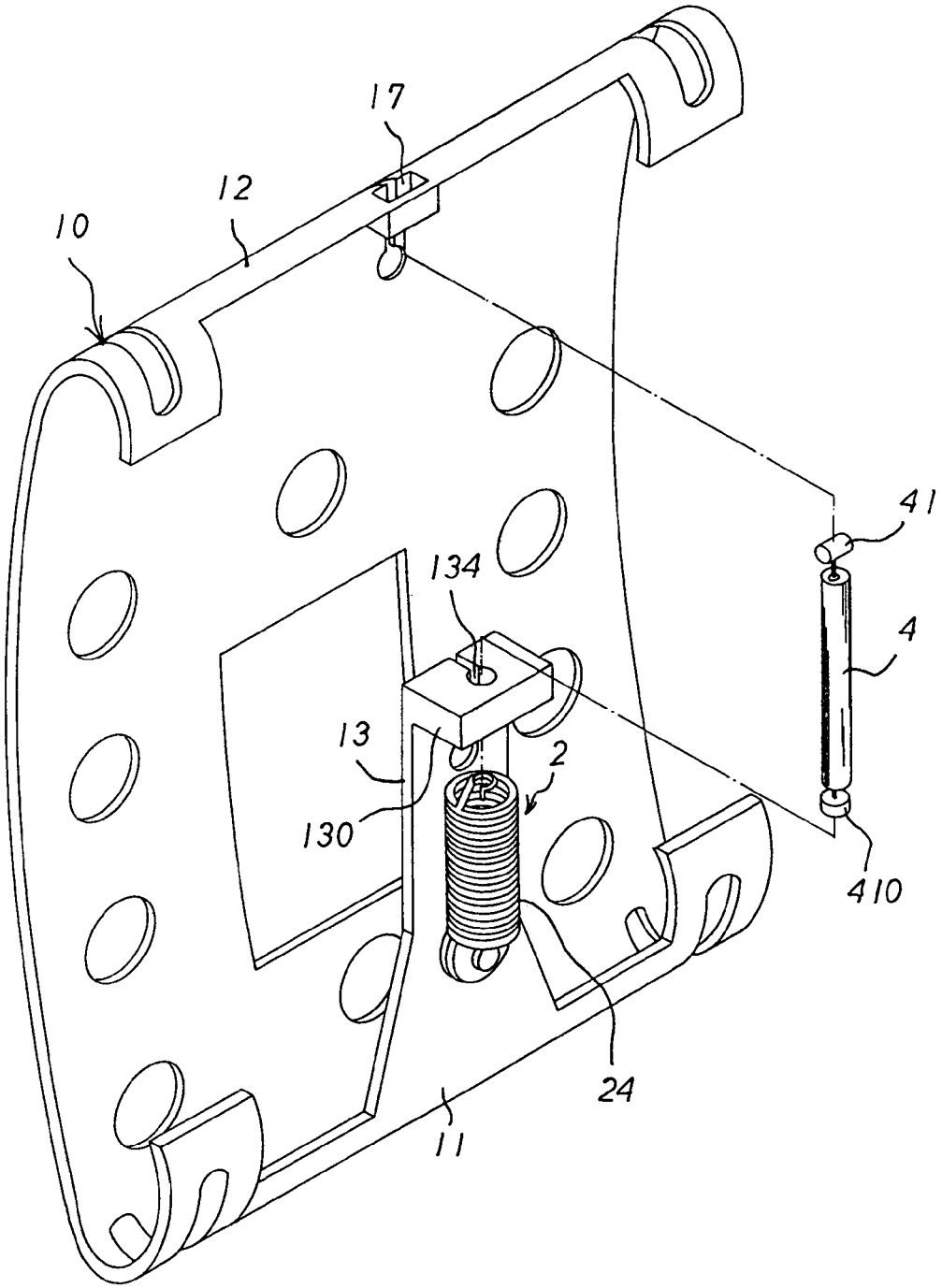
FIG. 8 is an exploded perspective view of a cushion in accordance with another embodiment of the present invention.
Figure 9:
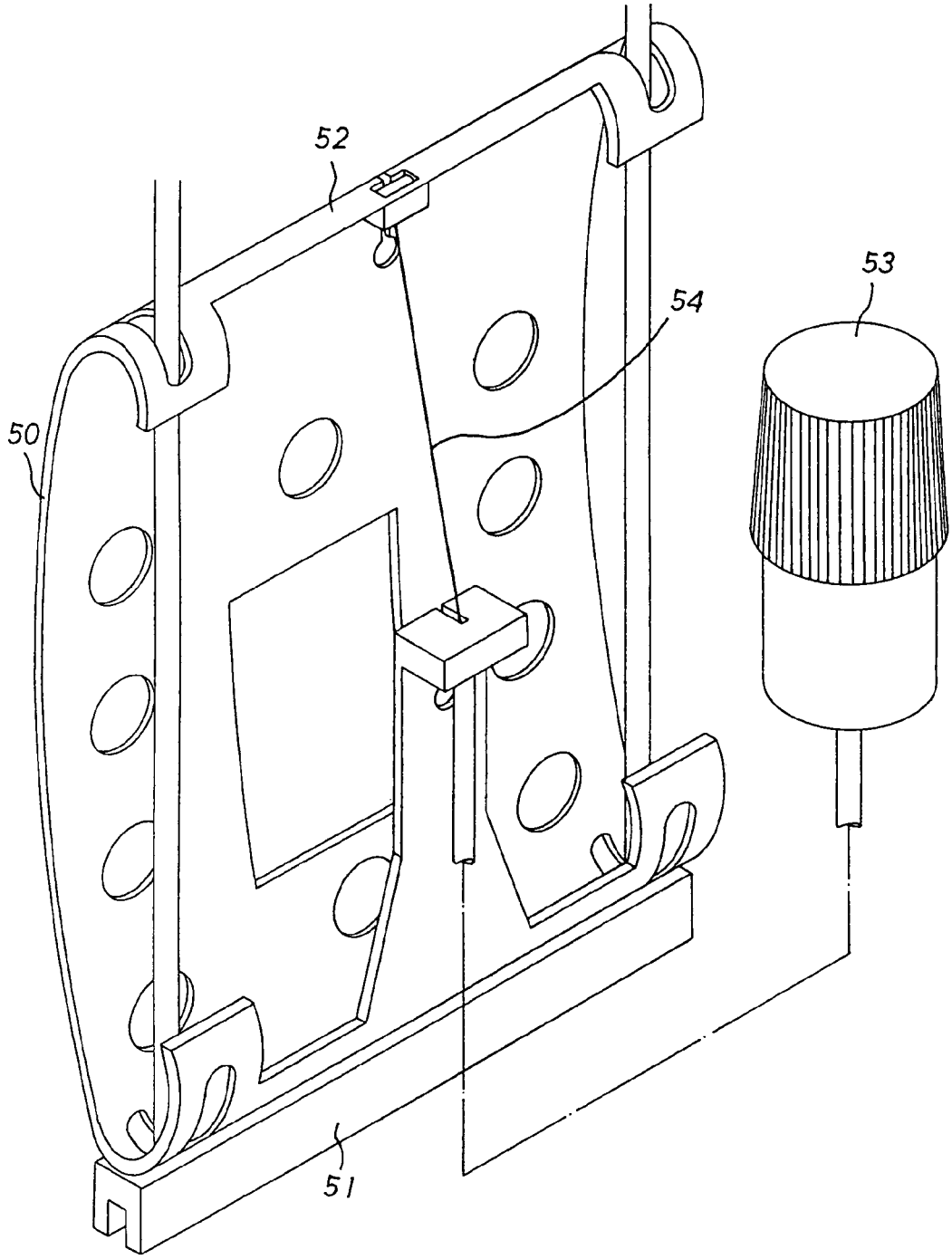
FIG.9 PRIOR ART
FIG. 9 is an exploded perspective view of a conventional cushion in accordance with the prior art.

Referring to FIG. 8, the movable portion 12 of the main body 10 has a mediate portion formed with a locking slot 17, the support face 130 of the support plate 13 is formed with a mounting hole 134, the elastic mechanism 2 includes a tensile spring 24 having a first end secured on the support plate 13 of the fixed portion 11, and the cushion further comprises a guide tube 4 slidably mounted in the mounting hole 134 of the support plate 13 and having a first end provided with a fixing rod 41 locked in the locking slot 17 of the movable portion 12 and a second end provided with a fixing plate 410 locked on a second end of the tensile spring 24.

Accordingly, the elastic mechanism 2 is stretched by the pulling action of the movable portion 12 of the main body 10 to counteract the user's weight and to mate with variation of the curvature of the main body 10, so that when the main body 10 is pressed and deformed by the user's weight, the main body 10 has a greater elastic action, and the curvature of the main body 10 is arbitrarily changed in an automatic manner by the elastic force of the elastic mechanism 2, so as to fit users of different statures and weights. In addition, the cushion only needs to provide the elastic mechanism 2 to reach the purpose of changing the curvature of the cushion arbitrarily, thereby decreasing costs of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A cushion, comprising:

a flexible curved main body having a first end formed with a fixed portion and a second end formed with a movable portion; and an elastic mechanism mounted on the main body and biased between the fixed portion and the movable portion of the main body; wherein the elastic mechanism includes a tensile spring having a first end secured on the fixed portion of the main body and a second end secured on the movable portion of the main body;

the fixed portion of the main body is formed with a support plate mounted on the first end of the tensile spring of the elastic mechanism;

the support plate of the fixed portion has a distal end formed with a planar support face to support the first end of the tensile spring of the elastic mechanism;

the support face of the support plate is formed with a through hole, the first end of the tensile spring is provided with a threaded rod extended through the through hole of the support face, and the elastic mechanism further includes a nut screwed onto the threaded rod of the first end of the tensile spring and rested on a side of the support face of the support plate.

2. The cushion in accordance with claim 1, wherein the support plate of the fixed portion is substantially inverted L-shaped.

3. The cushion in accordance with claim 1, wherein the fixed portion of the main body is formed with a support plate, and the elastic mechanism includes a support rod having a first end extended through the support plate of the fixed portion and a second end secured on the movable portion of the main body, and a compression spring mounted on the support rod and urged between the support plate of the fixed portion and the first end of the support rod.

4. The cushion in accordance with claim 3, wherein the support plate of the fixed portion has a distal end formed with a planar support face, and the first end of the support rod is provided with an urging plate rested on a first end of the compression spring which has a second end rested on a side of the support face of the support plate.

5. The cushion in accordance with claim 4, wherein the support face of the support plate is formed with a through hole, and the support rod is slidably mounted in the through hole of the support face.

6. The cushion in accordance with claim 3, wherein the movable portion of the main body is formed with a through hole, the second end of the support rod is formed with an outer thread extended through the through hole of the movable portion, and the elastic mechanism further includes a nut screwed onto the outer thread of the support rod and rested on a side of the movable portion.

7. The cushion in accordance with claim 1, wherein the fixed portion of the main body is formed with a support plate having a distal end formed with a planar support face formed with a mounting hole, the movable portion of the main body is formed with a locking slot, the elastic mechanism includes a tensile spring having a first end secured on the support plate of the fixed portion, and the cushion further comprises a guide tube slidably mounted in the mounting hole of the support plate and having a first end provided with a fixing rod locked in the locking slot of the movable portion and a second end provided with a fixing plate locked on a second end of the tensile spring.

8. A cushion, comprising: a flexible curved main body having a first end formed with a fixed portion and a second end formed with a movable portion; and an elastic mechanism mounted on the main body and biased between the fixed portion and the movable portion of the main body, wherein the elastic mechanism includes a tensile spring having a first end secured on the fixed portion of the main body and a second end secured on the movable portion of the main body;

the movable portion of the main body is formed with a support block mounted on the second end of the tensile spring of the elastic mechanism;

the support block of the movable portion is formed with a through hole, the second end of the tensile spring is provided with a threaded rod extended through the through hole of the movable portion, and the elastic mechanism further includes a nut screwed onto the threaded rod of the second end of the tensile spring and rested on a side of the movable portion.

* * * * *